United States Patent [19]

Langdon

[11] 3,942,723

[45] Mar. 9, 1976

[54] TWIN CHAMBERED GAS DISTRIBUTION SYSTEM FOR MELT BLOWN MICROFIBER PRODUCTION

[75] Inventor: Roy A. Langdon, Beloit, Wis.

[73] Assignee: Beloit Corporation, Beloit, Wis.

[22] Filed: Apr. 24, 1974

[21] Appl. No.: 463,460

[52] U.S. Cl. ..... 239/135; 239/543; 239/553; 239/568; 425/72 R

[51] Int. Cl.[2] ..... B05B 1/14

[58] Field of Search ..... 239/75, 76, 290, 296, 299, 239/418, 422, 426, 553, 543, 544, 553.3, 568, 597, 562, 553.5, 549, 135, 13; 425/7, 72

[56] References Cited

UNITED STATES PATENTS

| | | | |
|---|---|---|---|
| 3,379,811 | 4/1968 | Hartmann et al. | 425/72 X |
| 3,825,379 | 7/1974 | Lohkamp | 425/72 |
| 3,849,040 | 11/1974 | McGinnis | 425/72 |

*Primary Examiner*—John J. Love

*Attorney, Agent, or Firm*—Hill, Gross, Simpson, Van Santen, Steadman, Chiara & Simpson

[57] ABSTRACT

Forming system for generating from heated, pressurized gas a pair of flattened, angularly colliding gas streams, each stream being adapted to be on a different opposed side of a die head producing a plurality of generally aligned, spaced, hot melt strands of polymeric material or the like. The system employs a plenum chamber on each such opposed side, and heated, pressurized gas enters into and passes from each such chamber through a slotted nozzle associated therewith. The nozzles are positioned to produce the desired colliding gas streams. Each stream is substantially identical to the other.

12 Claims, 13 Drawing Figures

TWIN CHAMBERED GAS DISTRIBUTION SYSTEM FOR MELT BLOWN MICROFIBER PRODUCTION

BACKGROUND OF THE INVENTION

In the art of producing melt-blown microfibers, a plurality of spaced, aligned hot melt strands of polymeric material, or the like, are extruded downwardly simultaneously directly into the elongated zone of confluence formed by a pair of heated, pressurized, angularly colliding gas (usually air) streams, each stream typically being in a flat, sheet-like configuration and being on a different, opposed side of such strand plurality. The gas streams break up the strands into fine, filamentous structures, and move such forwardly, so that a non-woven mat thereof is continuously laid down upon a moving surface. The U.S. Naval Research Laboratory, Washington, D.C. and Esso Research and Engineering Company, Baytown, Texas, have heretofore reported research and development work on such process.

In the process, it is believed desirable to have the two flattened gas streams employed be not only as nearly identical to each other as practical (as respects such variables as gas composition, gas temperature, gas pressure, gas volume, stream angle with respect to the forward direction in which the strand plurality is being extruded, and the like), but also as uniform as possible. Thus, with respect to an individual one of such pair of streams, it is very desirable to control and maintain uniformly such variables as temperature, pressure, velocity, eddy currents, and the like. Preferably, each gas stream has a temperature about equal to that of the temperature of the strands in one presently preferred mode of practice.

In prior art apparatus used for the practice of this process, a pipe was located along each side of a die head adapted to extrude such strand plurality, and an elongated, slotted orifice in each pipe permitted air to escape therefrom and pass against each opposed side of such strand plurality. To supply heated air to each one of such pipes, a plurality of conduits in adjacent spaced relationship to each other joined the outside upper side wall of each such pipe; this arrangement was sometimes nick-named by those skilled in the art "the pipe organ". Unfortunately, this arrangement is not particularly easy or economical to construct or even to maintain. In addition, this arrangement characteristically produces a non-uniform temperature gradient along the mouth of each slotted orifice, causing a patterned variation of "hot" and "cold" spots therealong, these gradient differences being so great as to commonly cause a "striped" effect to appear in a non-woven web of melt blown microfibers produced with such arrangement. Such stripes indicate sheet thickness variations transversely along the path of web generation, and these thickness variations in turn are believed to be caused by temperature and perhaps even pressure variations in air stream uniformity along individual stream longitudinal width. Precise, accurate, stable, uniform individual gas streams are difficult, and probably impossible, to achieve with such prior art apparatus.

So far as is known, no one has heretofore discovered a system for the gas stream generation required in practicing the melt blown microfiber process which is well suited for large scale industrial utilization, which has associated favorable cost, maintenance, long life, and reliability features, and offers the potential of overcoming disadvantages of prior art apparatus above described, so that gas stream characteristics may be equalized and made uniform before being impinged upon a plurality of hot melt strands to be attenuated.

BRIEF SUMMARY OF THE INVENTION

There has now been discovered an improved apparatus and associated process adapted for forming a pair of flattened, angularly colliding gas streams. The apparatus employs no parts which move during operation and the associated process employs a pressure drop in each of a pair of gas streams. Each gas stream of such pair is intended to have substantially uniform properties, especially as respects temperature and pressure, and to be substantially identical to the other gas stream in such properties. Each gas stream is normally located in use on a different opposed side of a plurality of generally aligned, speced hot melt strands of polymeric material, or the like, of the type characteristically used in the manufacture of melt blown microfibers and non-woven webs thereof.

Each gas stream is produced through the use of its own separate single plenum chamber arrangement, one such arrangement being on each opposed side of such strand plurality. Heated, pressurized gas is fed to each plenum chamber wherein gas characteristics (such as temperature and pressure) equalize, and then each stream exits through a nozzle slot in each such chamber as a gas stream adapted to flow against one side of a row of strands being generated, equal but opposite stream angles being used.

It is an object of this invention to provide a system for achieving improved gas stream uniformity in a gas stream supply system for a melt blown microfiber production system.

Another object of this invention is to avoid the use of the prior art "pipe organ" arrangement.

Another object is to achieve a system for producing a gas stream supply for melt blown microfibers which avoids the temperature and even pressure variations of prior art systems and which is suitable for the production of substantially uniform pairs of gas streams for such a gas stream supply.

Another object of this invention is to produce a gas stream supply system for melt blown microfibers which uses a twin single plenum chamber arrangement with one plenum chamber being used for each individual one of the gas stream pair generated by such suply system.

Another object of this invention is to provide an improved gas stream supply system for melt blown microfibers which is intended to produce gas streams of substantially uniform properties.

Another object of this invention is to provide an improved process and an improved apparatus for a system of the type indicated which is economical to fabricate and maintain, adapted to be stable in operation, and simple to use and maintain.

Other and further objects, aims, purposes, advantages, utilities, and features will be apparent to those skilled in the art from a reading of the present specification and drawings.

DETAILED DESCRIPTION

Figure 1:
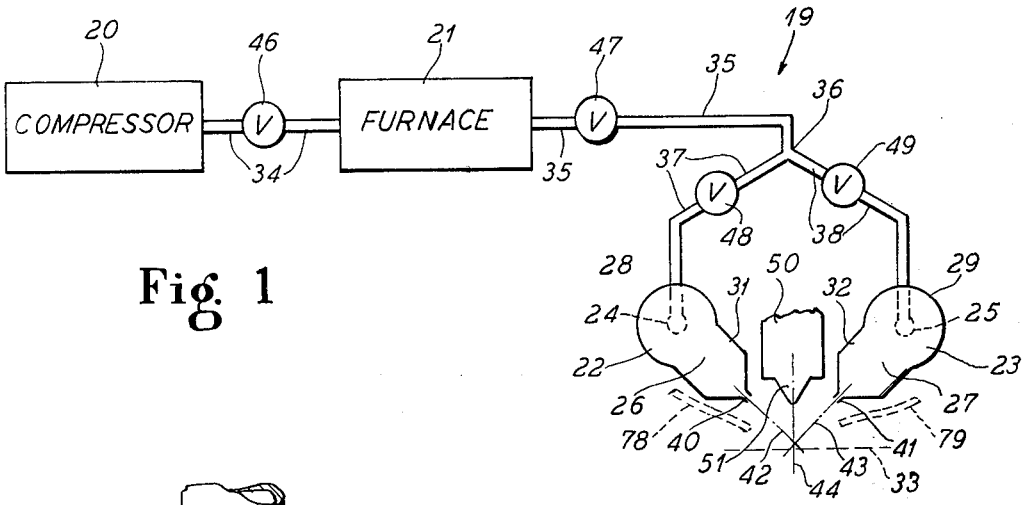
FIG. 1 is a schematic representation of operative principles of the present invention.

Referring to FIG. 1 there is seen a schematic diagram of an embodiment of a typical gas stream generating apparatus of the present invention herein designated in its entirety by the numeral 19. Apparatus 19 employs a means adapted to emit continuously a compressed gas of predetermined pressure, such as a conventional compressor 20. Output from the compressor 20 is fed through a tube 34 to a heating means adapted to heat the compressed gas to a predetermined temperature, such as a conventional furnace 21. If desired, the furnace can precede the compressor.

A pair of elongated plenum housings 22 and 23 are provided in spaced, preferably generally parallel, relationship to each other. Each such plenum housing 22 and 23, has an input port 24 and 25, respectively, defined therein (here shown in the opposite end walls of each such housing 22 and 23 though other locations may be chosen), and a longitudinally extending output port 26 and 27, respectively, defined in the respective side walls 28 and 29 thereof. A tube 35 from the furnace 21 interconnects at a tube Y-joint 36 with a pair of tubes 37 and 38 which each in turn, interconnect with input ports 24 and 25, respectively. If desired, input ports 24 and 25 may be constricted in cross-sectional area relative to the cross-sectional area of the respective tubes 37 and 38.

A pair of funnel shaped ducts 31 and 32 are provided. Each such duct 31 and 32 has a width which is longitudinally elongated, and each has a longitudinally elongated enlarged input mouth portion interconnected with and coterminous with the respective output ports 26 and 27 of plenum housings 22 and 23. Each duct 31 and 32 has a terminal constricted nozzle portion 40 and 41, respectively, of slotted shape. Such nozzle portions are in generally spaced, generally parallel, generally symmetrical relationship to each other so that, cross sectionally, the angle of inclination of opposed respective center portions 42 and 43 of each one of said nozzle portions 40 and 41 can range from between about 0° to 90°, with preferred such angles of inclination ranging from about 15° to 45°, with respect to the center 44 between such nozzle portions 40 and 41.

The relationship in apparatus 19 between said compressor 20, said furnace 21, said plenum housings 22 and 23, said tubes 34, 35, 36, 37 and 38 and said ducts 21 and 32 is such that heated, pressurized gas entering said plenum housings 22 and 23 from said tubes 34, 35, 36, 37 and 38 expands in said plenum housing 22 and 23 before such gas enters said ducts 31 and 32 and exits through said nozzle portions 40 and 41. Preferably little or no recompression of such gas occurs at output ports 26 and 27, but such gas more or less gradually, as it flows through ducts 31 and 32 preferably increases in pressure until a maximum pressure is reached at nozzle portions 40 and 41.

Tube 34 is equipped with a variable valve 46, tube 35 is equipped with a variable valve 47, tube 37 is equipped with a variable valve 48, tube 38 is equipped with a variable valve 49, all of which are so adjusted during operation of the apparatus 19 as to equalize the total volume of gas at a predetermined pressure entering the plenum housings 22 and 23 from the tubes 37 and 38 so that a substantially equal total volume of air is emitted during operation of the apparatus 19 from each of the nozzle portions 40 and 41. The position where and manner in which tubes 37 and 38 interconnect with each plenum housing 22 and 23 is preferably such that gas entering a housing 22 or 23 does not escape through nozzle portions 40 and 41 prematurely before undergoing the desired depressurization in plenum housings 22 or 23. Automatic control means may be employed if desired.

In addition, the apparatus 19 further includes a conventional temperature control means, including a thermostat means or the like (not shown) which is employed to regulate the temperature of gas entering each of the plenum housings 22 and 23 from tubes 37 and 38 so that gas so charged into each one of the plenum housings 22 and 23 from the tubes 37 and 38, respectively, is at approximately the same predetermined temperature as it enters each of the plenum housings 22 and 23, respectively.

In the apparatus 19, the relationship between the tube means 37 and 38, and the associated plenum housings 22 and 23, is such that gas entering such plenum housing 22 and 23 from the tube means 37 and 38 expands to a pressure of at least about 5 relative to that of its total pressure in each of the respective supply or feed tubes 37 and 38. Preferably this expansion pressure ratio falls in the range of from about 4:1 to 5:1, based on a constant air volume in the respective ones of tubes 37 and 38 and in the respective ones of the adjoining plenum housings 22 and 23. Not more than two tubes supply heated, pressurized gas to an individual plenum chamber.

When the apparatus 19 of the present invention is in an operative configuration, each one of the plenum housings 22 and 23 with its respective associated funnel shaped ducts 31 and 32 is so located spatially in relation to an elongated die body 50 that the nozzle portions 40 and 41 are adjacent the forward end or nose 51 of a die body 50 with the nozzle portions 40 and 41 being in generally opposed relationship to each other so that such nozzle portions 40 and 41 are adapted to supply during operation of the apparatus 19 a desired pair of angularly colliding gas streams intended to be of matching, uniform properties, one on either side of the forward end 51 of die body 50 from which a plurality of aligned strands of hot melt issue during operation. Each nozzle portion 40 and 41 is preferably equally distant from the strands during apparatus operation, but at a complementary angle with respect to each other.

Although gas temperatures and pressures can vary widely, depending upon material being stranded, process conditions, product desired, and many other variables, typical gas temperatures in a tube 37 or 38 range from about 550° to 750°F. while typical gas pressures in a tube 37 or 38 range from about 5 to 30 psig. Similarly, gas temperatures at a nozzle portion 40 or 41 are in the same range with typical gas pressures at a nozzle portion 40 or 41 ranging from about 5 to 30 psig. Gas temperatures at the respective exits of nozzle portions 40 and 41 are generally less than the temperatures of gas supplied to distributor conduits 140 and 141 due to inherent expansion cooling; typical temperatures at respective nozzle portions 40 and 41 range from about 400° to 520°F. Pressures at the respective exits of nozzle portions 40 and 41 are substantially atmospheric, but pressures at the respective entrances to nozzle portions 40 and 41 are only slightly below gas supply pressures and typically range from about 4.8 psig to 29.5 psig.

The width of a gas stream issuing from a nozzle portion 40 or 41 typically ranges from about 0.007 to 0.12 inch with the length thereof being dependent upon the length of the plenum housing 22 or 23, which in turn is chosen so as to be about the length of a die body 50. Gas issuing from a nozzle portion 40 or 41 is typically moving at a velocity of from about 400 to 1,650 feet/-second in accordance with process variables desired in the art of producing melt blown microfibers, but the upper limit is sonic velocity which varies with temperature.

As those skilled in the art will appreciate, it is conventional to employ, in apparatus for generating melt blown microfibers, a moving surface, such as shown by the dotted line 33 in FIG. 1, against which the melt blown microfibers impinge and form a web. Also, it is sometimes convenient to employ in such a process a source of secondary gas (usually air) which gas is at pressures only slightly above atmospheric and which is usually at ambient temperatures. Such secondary gas stream is provided by appropriate conduits 78 and 79 (see FIG. 1) located on outer sides, respectively, of the nozzle portions 40 and 41. The secondary gas facilitates air flow from the nozzles 40 and 41 and is particularly advantageous when a plurality of die bodies 50 are employed in a single melt blown microfiber production operation.

The moving surface 33 and the secondary air supply, such as provided by conduits 78 and 79, are sub assemblies which are not a part of the present invention and so are not described in detail herein, particularly since such are known generally to the prior art.

The apparatus 19 of this invention may be adapted for use with a plurality of die bodies 50, each such die body 50 being equipped with its own apparatus 19 or equivalent. Observe that the tube 35 may interconnect with a plurality of tube Y-joints 36 so that a single unit of this invention can include a plurality of plenum housing pairs 22 and 23 with associated components, such as tubes 37 and 38 and the like, and still use only a single compressor 20 and a single furnace 21, as those skilled in the art will appreciate.

Figure 2:
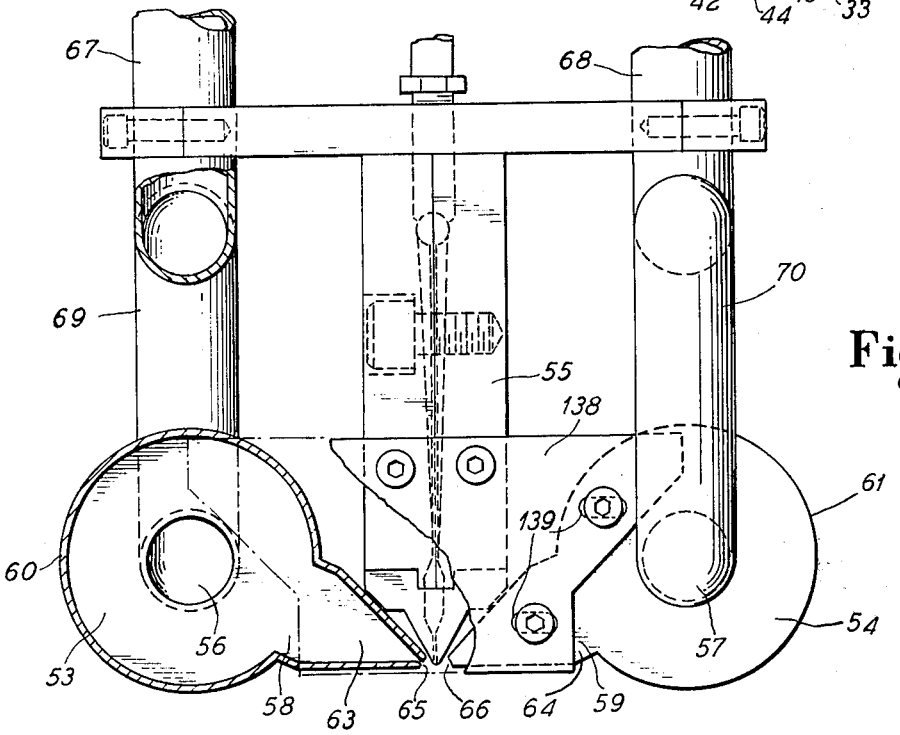
FIG. 2 is an end elevational view of one embodiment of apparatus of the present invention, some parts thereof broken away and some parts thereof shown in section.

Referring to FIG. 2, there is seen an end elevational view of an embodiment of a pair of plenum chambers and associated elements incorporating the teachings of the present invention. Thus, a pair of plenum housings 53 and 54 are positioned in spaced, generally parallel relationship to each other in symmetrical fashion, one on either side of a die body 55. The internal structure of die body 55 is not part of this invention, but can be as desired for use in melt blowing microfibers, as those skilled in the art will appreciate; for illustration herein, die body 55 may have a structure as described hereinafter for die body assembly 89 as shown in FIGS. 5 and 9–13. Plenum housing 53 has centrally located in opposite end walls thereof a pair of input ports 56 and plenum housing 54 has similarly located in it a pair of input ports 57. A longitudinally extending output port 58 and 59, respectively, is defined in a side wall portion 60 and 61, respectively, of each plenum housing 53 and 54.

A pair of funnel shaped ducts 63 and 64 are provided, each such duct 63 and 64 having a width which is longitudinally elongated and further having a longitudinally elongated input mouth portion which is interconnected to, and is coextensive with, the output ports 58 and 59 of a different one of the plenum housings 53 and 54, respectively. In addition, each duct 63 and 64 has a terminal, longitudinally elongated slotted nozzle portion 65 and 66. The nozzles 65 and 66 are in generally spaced, generally parallel, generally symmetrical relationship to each other such that, cross sectionally, the complementary respective angles of inclination of opposed center portions of each one of the nozzle portions 65 and 66 ranges from between about 0° to 90° with respect to the center midway between such nozzle portions 65 and 66 all as earlier above indicated in reference to FIG. 1.

Figure 3:
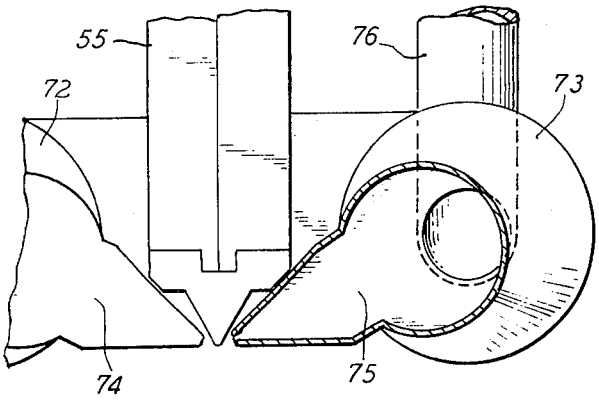
FIG. 3 is a view similar to FIG. 2 but showing a portion of an alternative arrangement for the apparatus of the type as shown in FIG. 2.
Figure 4:
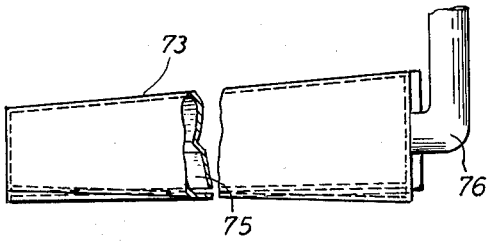
FIG. 4 is a diagrammatic view in longitudinal side elevation showing a portion of the apparatus illustrated in FIG. 3, some parts thereof broken away and some parts thereof shown in section.

In order to provide heated pressurized air for each of the plenum housings 53 and 54, a primary duct or tube 67 and 68 is provided for each respective plenum housing 53 and 54, each tube 67 and 68 being supplied with heated, compressed gas in, for example, the manner above indicated in reference to FIG. 1, although any convenient arrangement may be employed to supply compressed, heated gas to the apparatus shown in FIGS. 2–4, as those skilled in the art will appreciate. Each tube 67 and 68 joins a cross duct 69 and 70, respectively, so that such gas is fed simultaneously to the opposed end regions of each respective plenum housing 53 and 54. Such an arrangement aids in distributing gas uniformly within the respective plenum housings 53 and 54 which are here each more than one foot in length.

Although the plenum housings 53 and 54 are tubular and thus circular in cross-section, those skilled in the art will appreciate that other cross sectional configurations for plenum housings 53 and 54 may be employed. Thus, for example, referring to FIGS. 3 and 4, there is seen an embodiment similar to that shown in FIG. 2, but wherein the plenum housings 73 and 74, respectively, each have tapered side wall portions proceeding from one end to the other thereof. Thus, heated, pressurized gas enters only at one end, the enlarged end, each respective plenum housing 72 and 73 as from paired tubes 76. As the gas passes down the tapered interior of either plenum housing 72 or 73 the desired pressure equalization results so that gas pressure and temperature along each of the output ports 74 and 75, respectively, of plenum housings 73 and 74 is adapted to be substantially equal, based upon constant streams at constant temperatures entering through the tubes 76.

Figure 5:
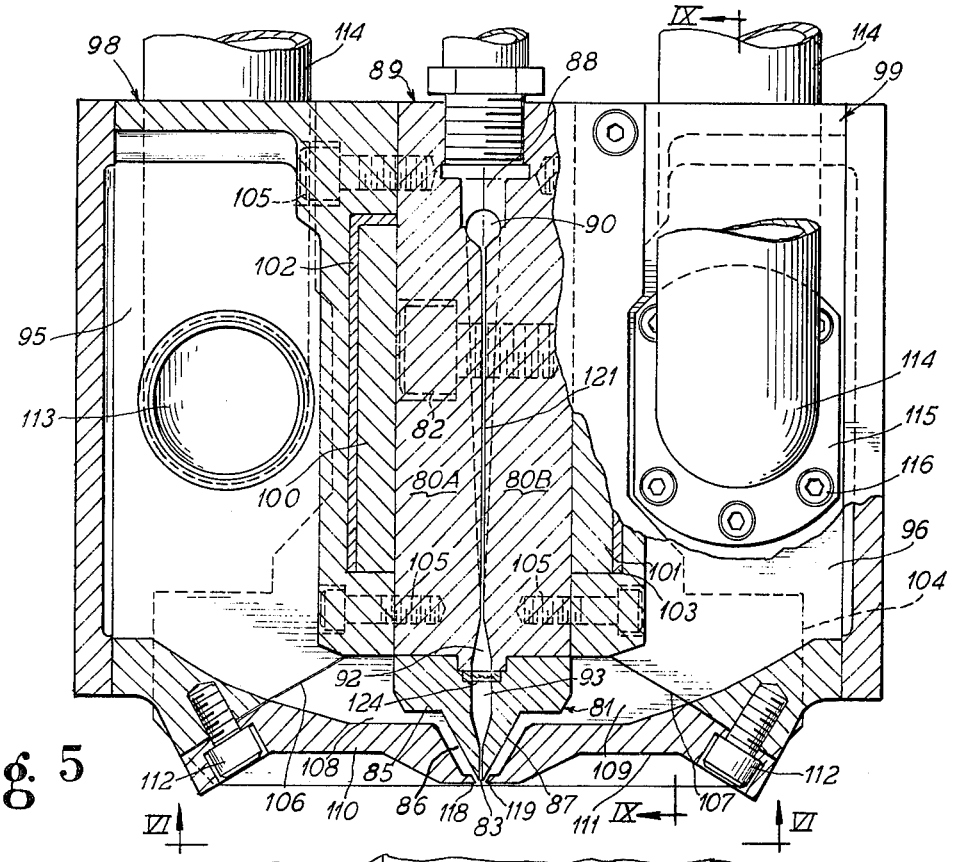
FIG. 5 is a vertical, sectional view showing another embodiment of apparatus of the present invention, some parts thereof shown in end elevation, and some parts thereof broken away.
Figure 6:
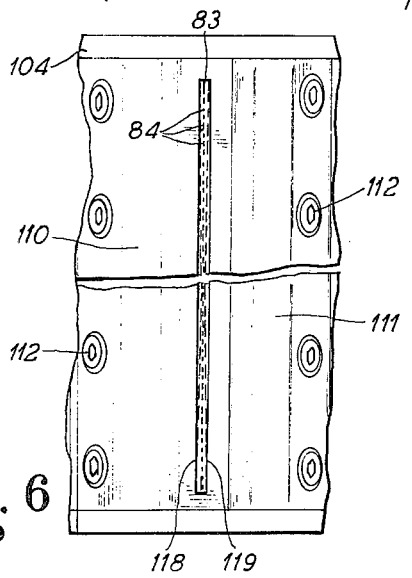
FIG. 6 is a fragmentary bottom plan view taken along the line VI—VI of FIG. 5, some parts thereof broken away.
Figure 8:
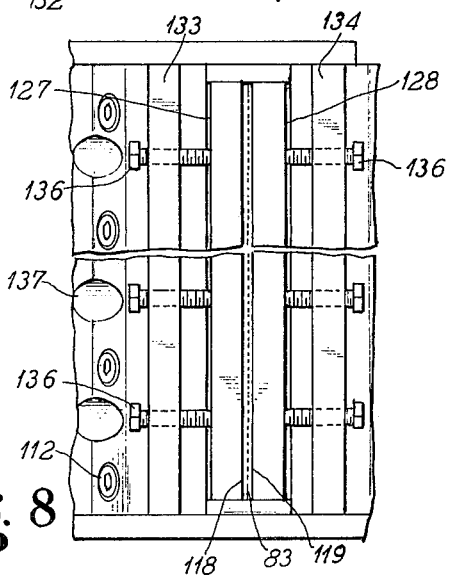
FIG. 8 is a fragmentary bottom plan view, taken along the line VIII—VIII of FIG. 7, some parts thereof broken away.
Figure 9:
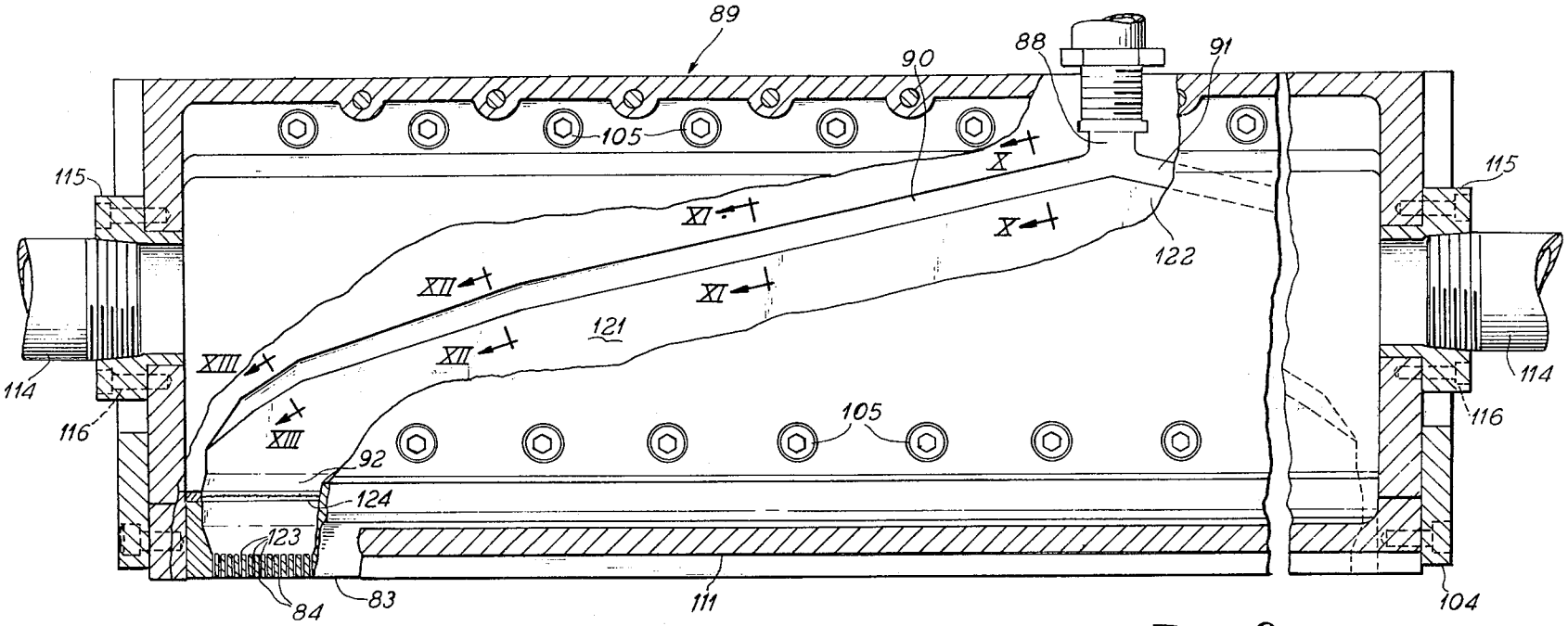
FIG. 9 is a transverse sectional view taken along the line IX—IX of FIG. 5, some parts thereof broken away and some parts thereof shown in section, with special emphasis being given to illustrating the melt distribution system employed in the die body shown in the embodiment of FIG. 5.
Figure 13:
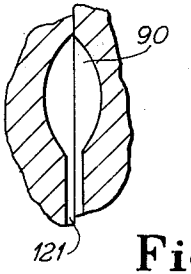
FIG. 13 is an enlarged, fragmentary, detail view taken along the line XIII—XIII of FIG. 9.
Figure 12:
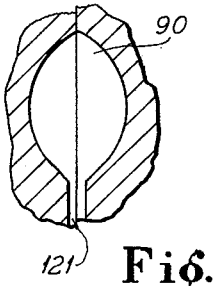
FIG. 12 is an enlarged, fragmentary, detail view taken along the line XII—XII of FIG. 9.
Figure 11:
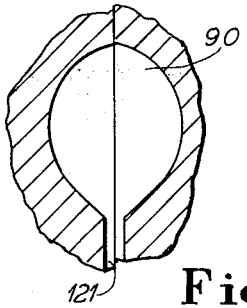
FIG. 11 is an enlarged, fragmentary, detail view taken along the line XI—XI of FIG. 9.
Figure 10:
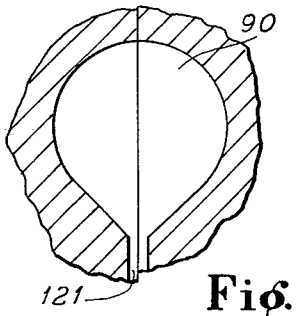
FIG. 10 is an enlarged, fragmentary, detail view taken along the line X—X of FIG. 9.

In FIG. 5 is seen a presently preferred embodiment of a plenum chamber system of the present invention. Here, a die assembly 89 has a die body formed of a pair of mating halves designated as 80A and 80B and a die nose 81. The die nose 81 is mounted by its enlarged base 85 against the forward face of the die body 80A/80B by appropriate bolts (not shown). The respective halves 80A and 80B are secured together by means of bolts 82. The die nose 81 has a forwardly located elongated narrow planar face 83. A plurality of orifices 84 (see FIG. 6) are defined in the face 83 and are adapted for simultaneous extrusion therefrom of a plurality of spaced aligned parallel strands (not shown) of a hot melt of plastic material or the like during operation of such apparatus. On either exterior side of the face 83 and adjoining same is a pair of forwardly tapered, planar, opposed side walls 86 and 87 which extend back to the base 85.

The assembled die body mating halves 80A and 80B are equipped centrally with a rearwardly opening melt input port 88 leading into the interior thereof. The interior of die body 80A/80B is adapted to distribute therewithin a melt entering the input port 88 so that when the melt reaches the orifices 84 and exits therefrom, the melt is uniformly distributed and evenly extrudes uniformly from such orifices 84. To achieve such melt distribution within the die body 80A/80B, the opposed engaging surface portions of the respective die body halves 80A and 80B are machined so that when such halves 80A and 80B are brought together into mating engagement (see FIGS. 5 and 9), there is defined therebetween a pair of diverging main channels 90 and 91. These channels 90 and 91 extend in generally opposed directions away from the melt input port 88 with which they commence. Each of these channels 90 and 91 is tapered along the length thereof, as shown by FIGS. 10 through 13, opens on its forward (or bottom) side into channels 121 and 122, respectively, so as to permit a hot melt to move continuously from each channel 90 or 91 downwardly or forwardly towards a longitudinally extending chamber region 92 formed in die body 80A/80B adjacent the forward face thereof where the rear face of the die nose 81 abuts.

Formed in the die nose 81 is a mating longitudinally extending chamber 93. The forward portion of the chamber 93 is tapered and interconnects forwardly with the individual channels 123 terminating in the orifices 84 in the forward face 83 of the die nose 81. The overall arrangement of the channels 90 and 91, channels 121 and 122, chamber 92, chamber 93, and channels 123 is conventional and is known to those skilled in the art as a "coat-hanger" type of melt distribution system. Any convenient distribution arrangement may be used for distributing a hot melt within a die assembly 89 for purposes of the present invention. It is preferred to manufacture a die assembly 89 of metal which has been machined to close tolerances so that metal to metal seals between the die body halves 80A and 80B, and between such halves 80A and 80B and die nose 81, may be employed without necessity to employ independent sealing means as is conventional in die manufacture.

On each side of the die assembly 89 is positioned an elongated plenum chamber 95 and 96. Each such plenum chamber 95 and 96 is defined by the walls of a plenum housing 98 and 99, respectively. Each plenum housing 98 and 99 has its top wall portions, bottom wall portions and end wall portions integrally formed with its respective inside wall portions. The outside wall of each plenum housing 98 and 99 is formed by a separate plate member which is secured to such top, bottom and end wall portions by any convenient means, here by bolts (not shown) threadably received within such top, bottom, and end wall members and passing through the perimeter edges of such outside walls.

Between the outside walls of the die body 80A/80B and the adjacent inside walls of the plenum housings 98 and 99, a recess is formed within which is accommodated heater members 100 and 101, respectively, of a conventional electric resistance coil, or the like, the heaters 100 and 101 preferably being mounted against the die body 80A and 80B. These heaters 100 and 101 aid an operator in maintaining a substantially uniform temperature within the die body 80A/80B. Such heaters 100 and 101 also help maintain the wall of the plenum chambers 95 and 96 at a uniform temperature which better enables one to control the uniformity of the temperature of gas being processed in accordance with the teachings of the present invention. Optionally, as shown in FIG. 5, layers 102 and 103 of insulation is provided between the respective heaters 100 and 101 and the adjacent inside walls of the plenum housings 98 and 99, respectively. These insulation layers 102 and 103 tend to prevent rapid changes in the temperature of the system, such as might occur through a sudden alteration of gas temperature within the plenum chambers 95 and 96, as during a start up, shut down or process change-over of apparatus embodying this invention.

Optionally and preferably, a screen member 124 is mounted transversely across the mouth of the chamber 93 to prevent any foreign solid bodies within a polymer hot melt from entering the forward portion of the die nose 81 and possibly plugging channels 23.

To rigidify the assembly, a pair of face plates 104 is mounted one over each opposed end of die assembly 89 and the adjacent ends of the plenum housings 98 and 99. The face plates 104 are secured to the respective end walls of the plenum housings 98 and 99 by means of bolts or the like matingly received within appropriate threaded sockets formed in the respective end walls of the plenum housings 98 and 99. Between the bottom wall and the inside wall of each plenum housing 98 and 99 an output port 106 and 107 is formed. Each bottom wall adjacent each output port 106 and 107 is so shaped that the ports 106 and 107 are inclined at complementary angles with respect to one another in spaced, symmetrical relationship. These output ports 106 and 107 extend over approximately the entire longitudinal length of each plenum housing 98 and 99, respectively.

A pair of generally funnel shaped ducts 108 and 109 are provided over each output port 106 and 107, respectively. Each duct 108 and 109 extends between respective output ports 106 and 107 and the face 83 of the die nose 81. Each duct 108 and 109 is defined by a combination of wall portions of the respective plenum housings 98 and 99, the respective side walls 86 and 87 of the die nose 81, and by a pair of cap plates 110 and 111, respectively. Each cap plate 110 and 111 is secured to a different bottom wall of respective plenum housings 98 and 99 adjacent the respective output ports 106 and 107 thereof by means of bolts 112 threadably received within appropriate sockets formed in the plenum housing bottom walls 98 and 99. The cap plates 110 and 111 cooperate with the side walls 86 and 87 of die nose 81 to define the desired nozzles 118 and 119 adjacent the die face 83 whereby a desired pair of angularly colliding elongated gas streams may be generated in accordance with the teachings of the present invention. As those skilled in the art will appreciate, the internal surface configuration of the cap plates 110 and 111, particularly in the region of the side walls 86 and 87 of the die nose 81, can be adjusted or chosen for optimum operating efficiency in a given apparatus embodiment. Plenum housing 98 has a pair of input ports 113, one in each opposed end wall thereof, and plenum housing 99 similarly has a pair of input ports, one in each opposed end wall thereof. To each such input port 113 is joined a tube, such as tube 114 by bolts 116 extending through a flange 115 thereof into end walls of plenum housings 99. These tubes, such as tube 114 connect with, in turn, other tubes (not shown) to complete the air supply system for this assembly which is conventional.

It is much preferred in the system of the present invention to employ in a given embodiment thereof means for adjusting the size and position of gas stream orifices in relation to their respective relative positions adjacent a plurality of hot melt strands. For example, in the embodiment shown in FIG. 5 some adjustability is provided before the nozzles 118 and 119, respectively, defined by the cap plates 110 and 111 in relation to the die nose 81, since the plurality of bolts 112 employed provides a measure of adjustability for regulating the size of the orifices 118 and 119, respectively, along the slotted length thereof. Shims may be provided between adjacent surfaces of the cap plates 110 and 111, respectively, and the adjoining surfaces of the plenum housings 98 and 99. Such adjustability or orifice dimensions is convenient because it has been found that it is possible for a given nozzle 118 and 119 to expand in its mid section along a die face 83 during operation, owing to thermal changes occurring in respective plenum housings 98 and 99 which is an undesirable effect. One way of compensating for such expansion is to preset the gaps for nozzles 118 and 119 in the mid-section along die face 83 before a startup so that after the apparatus has reached a desired operating temperature, the nozzles 118 and 119 have, in their heated and expanded condition, the desired dimensions in their respective mid sections.

Figure 7:
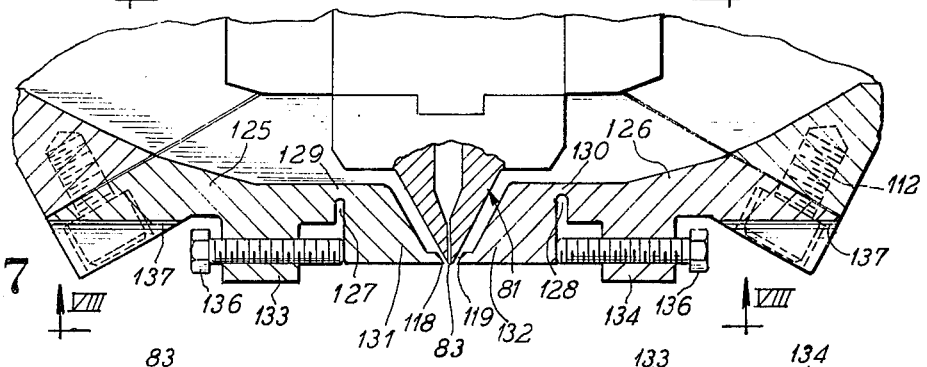
FIG. 7 is a vertical, sectional, enlarged detail view through the orifice region of the embodiment shown in FIG. 5 illustrating an alternative arrangement for the apparatus of the type as shown in FIG. 5.

An alternative arrangement permitting the regulating of the size of the nozzles 118 and 119 is shown in the cap plate embodiment illustrated in FIG. 7. Here, cap plates 125 and 126 are each equipped with adjustment means. The adjustment means includes a slot 127 and 128, respectively, longitudinally formed in the outside face of each cap plate 125 and 126, the depth of the slots 127 and 128 being chosen so as to provide a pivotal, yieldingly biased, arcuate movement in the regions 129 and 130 of cap plates 125 and 126 adjacent the slots 127 and 128 when leverage is applied by bolts against terminal bodies 131 and 132, respectively, of cap plates 125 and 126 adjacent the die nose 81 so that the size of the orifices 118 and 119 is controlled. Adjustment bolts 136 are mounted in threaded bores transversly formed in longitudinally extending ridges 133 and 134 formed on the outside walls of respective cap plates 125 and 126, there being a plurality of longitudinally spaced adjustment bolts 136 transversely mounted through each ridge 133 and 134. Suitable grooves 137, are cut in the cap plates 125 and 126 so as to permit the adjustment bolts 136 to extend in a horizontal direction through the ridges 133 and 134, respectively, and to have the ends of bolts 136 abut against the surface of the terminal bodies 131 and 132 which are then pivotably moved in response to the adjustment given to the bolts 136, as those skilled in the art will appreciate.

Some adjustability for the embodiment shown in FIG. 2, above, is provided by means of a pair of end plates 138 secured to opposed end regions of the adjacent plenum housings 53 and 54. The end plates 138 are bolted to the housings 53 and 54 through slotted apertures 139.

Any convenient means, as those skilled in the art will appreciate, may be employed to achieve adjustment of nozzles employed in apparatus of the present invention.

The present invention includes a process for forming a pair of angularly colliding elongated gas streams of substantially uniform but equal characteristics. The process comprises a series of steps which are practiced continuously and occur simultaneously in operation of apparatus of this invention. In a first step, one charges a heated, pressurized gas to a pair of plenum zones under conditions such that, as the heated pressurized gas enters such a plenum zone, it undergoes a controlled expansion therewithin. The amount of expansion is substantially identical in each one of the two zones. The pressure and temperature associated with the gas charged to each respective zone to being substantially identical. Each of the plenum zones is substantially identical to the other thereof in size and configuration. Conditions of expansion of a gas within such a plenum zone are as described hereinabove.

In a second step, one releases the gas from each elongated plenum zone through an elongated side outlet portion formed along the length of each plenum zone. The relationship between each one of such pair of outlet portions is such that the pressurized heated gas is so released from each plenum zone at a generally uniform and constant rate along such side outlet portion. Gas released through each outlet portion is compressed and released through a nozzle adapted to produce one of the two streams of air desired. The nozzles are in spaced, symmetrical relationship to cause the so-released air streams to collide angularly. Preferably in the operation of a process of the present invention, the gas is released from the nozzle zone at a temperature in the range of from about 600° to 700°F while the pressure of such gas is in the range of from about 5 to 30 psig. The temperature and pressure of the gas are dependent upon the operating conditions selected. As the heated pressurized gas is released from each plenum zone, the conditions of release are regulated so that the streams collide with one another at an angle for each stream which is substantially identical to the other thereof. This angle can range very widely but it is preferably within the range of from about 15° to 45° with respect to the vertical line between the regions of release or the nozzle zones.

The angularly colliding gas streams preferably strike a plurality of spaced aligned hot melt strands one on each side thereof, as indicated hereinabove. Each such strand initially ranges in average diameter of from about 0.008 to 0.022 inches and the spacing between strand centers ranges from about 0.030 to 0.050. Preferably these so extruded hot melt strands move downwardly and are oriented so as to lie substantially on a (hypothetical) vertical plane lying midway between the two colliding gas streams and preferably the strands are extruded in a vertical downwardly extending direction. In one preferred mode of operation the temperature of the gas streams is approximately equal to that of the hot melt.

While for illustrative purposes the embodiments hereinabove have utilized funnel shaped duct means interconnecting each plenum chamber with each nozzle, those skilled in the art will appreciate that such duct means need not necessarily be funnel shaped, and that, indeed, one can so position the pair of plenum chambers relating to a die body that such duct means may be minimized and even eliminated so that a nozzle may be substantially directly associated with its plenum chamber. Any convenient means interconnecting a nozzle with its plenum chamber may be employed.

Preferably a nozzle is continuous and uninterrupted so that the flow of gas therethrough is not impeded.

Other and further embodiments and variations of the present invention will become apparent to those skilled in the art from a reading of the present specification taken together with the drawings and no undue limitations are to be inferred or implied from the present disclosure.

I claim:

1. Apparatus adapted to form a pair of angularly colliding, elongated gas streams comprising:

A. a pair of elongated plenum housing means in spaced relationship to each other, each such plenum housing means defining therewithin an elongated plenum chamber and having plenum input port means defined therein and a plenum output port means defined in longitudinally extending wall portions thereof, B. a pair of elongated nozzle means, each one being interconnected in fluid-tight engagement with a different one of said plenum housing means, each said nozzle means having a longitudinally elongated nozzle input port means defined therein and a longitudinally elongated nozzle orifice defined therein, said plenum output port means communicating with said nozzle input port means, each of said nozzle output orifices being in spaced, parallel relationship to the other thereof and oriented angularly so that cross-sectionally the angle of inclination between respective center planes of said output orifices relative to each other ranges from about 90° to 180°, said nozzle input port means being substantially wider in width than the width of said nozzle output orifice in each of said nozzle means, the side walls of each said nozzle means generally defining a taper between said nozzle input port means and said nozzle output orifice thereof, C. the relationship between each of said input port means and said plenum housing means associated therewith being such that a pressurized gas entering such plenum housing means from such input port means expands in such plenum housing over its pressure in the region of said input port means to an extent such that the ratio of gas pressures before and after such expansion is at least about 4:1, and D. means for adjusting the width of each of said nozzle output orifices along the length thereof.

2. The apparatus of claim 1 wherein said expansion ratio is in the range from about 4:1 to 5:1 and one said side wall of each of said nozzle means is characterized by having longitudinally therealong on the outside thereof generally upstanding post means in transversely spaced relationship to said nozzle output orifice thereof, flange means extending longitudinally along the outside of said one side wall adjacent said nozzle output orifice thereof, said post means of each said one side wall having transversely extending therefrom in adjustable threaded engagement therewith screw means which has a screw means end portion extending towards and adapted to abut against a portion of the adjacent said flange means of the same said one side wall, each said screw means being adapted to coact with the associated said post means, said flange means and said one side wall to permit width adjustment of said nozzle output orifice in regions adjacent thereto.

3. The apparatus of claim 1 wherein said expansion ratio is in the range from about 4:1 to 5:1.

4. The apparatus of claim 1 further including gas supply means adapted to emit continuously a pressurized gas, and tube means interconnecting said gas supply means with each of said input port means.

5. Apparatus adapted to form a pair of angularly colliding, elongated gas streams comprising:

A. gas supply means adapted to emit continuously a pressurized gas,

B. heating means adapted to heat said gas to an elevated temperature,

C. a pair of elongated plenum housing means in spaced relationship to each other, each such plenum housing means defining therewithin an elongated plenum chamber and having plenum input port means defined therein and a plenum output port means defined in longitudinally extending side wall portions thereof, D. a pair of elongated nozzle means, each one being interconnected in fluid-tight engagement with a different one of said plenum housing means, each said nozzle means having a longitudinally elongated nozzle input port means defined therein and a longitudinally elongated nozzle output orifice defined therein, said plenum output port means communicating with said nozzle input port means, and being generally coextensive therewith, each of said nozzle output orifices being in spaced, parallel relationship to the other thereof and oriented angularly so that cross-sectionally the angle of inclination between respective center planes of said output orifices relative to each other ranges from about 90° to 180°, said nozzle input port means being substantially wider in width than said nozzle output orifice in each said nozzle means, the side walls of each said nozzle means generally defining a taper between said nozzle input port means and said nozzle output orifice thereof, E. tube means functionally interconnecting said gas supply means, said heating means, and each of said input port means, and adapted to deliver heated, pressurized gas into each of said plenum housing means, F. the relationship between each of said input port means and said plenum housing means associated therewith being such that a pressurized gas entering such plenum housing means from such input port means expands in such plenum housing over its pressure in the region of said input port means to an extent such that the ratio of gas pressures before and after such expansion is at least about 4:1, and G. means for adjusting the width of each of said nozzle output orifices along the length thereof.

6. The apparatus of claim 5 wherein said expansion is in the range from about 4:1 to 5:1.

7. The apparatus of claim 5 wherein said tube means are equipped with variable valve means adapted to regulate the volume of gas at a predetermined pressure entering each of said plenum housing means from said tube means so that a substantially equal, predetermined volume of air is emitted during operation of said apparatus from each one of said nozzle portions.

8. The apparatus of claim 5 wherein each of said plenum housing means with its associated nozzle means is so located spatially in relation to an elongated die body interposed therebetween that (A) said nozzle output orifices are adjacent the forward end of said die body in opposed relationship to each other, and (B) said nozzle output orifices are adapted to supply during operation of said apparatus a pair of angularly colliding gas streams one on either side of said die body's forward end.

9. The apparatus of claim 1 further including means for adjusting the spatial orientation of said nozzle output orifices relative to each other.

10. The apparatus of claim 1 wherein said plenum input port means is located in an end region of said plenum housing means.

11. The apparatus of claim 10 wherein said plenum housing means has longitudinally tapered side wall portions proceeding generally from said end region to the opposite end region.

12. The apparatus of claim 1 wherein said plenum input port means are located in both opposed end regions of said plenum housing means whereby heated gas can be fed simultaneously through such plenum input port means into said elongated plenum chamber.

* * * * *